US005685807A

United States Patent [19]

Tong et al.

[11] Patent Number: 5,685,807

[45] Date of Patent: Nov. 11, 1997

[54] BOUNCING BOOT

[76] Inventors: Kui Kwong Tong, 10111 Lassam Road, Richmond, British Columbia, Canada, V7E 2C2; Vincent Man Kie Tong, 6363 Christie Ave. #904, Emeryville, Calif. 94608

[21] Appl. No.: 551,194

[22] Filed: Oct. 31, 1995

[51] Int. Cl.[6] ..... A63B 26/00

[52] U.S. Cl. ..... 482/77; 482/75

[58] Field of Search ..... 482/77; 36/7.5, 36/7.8, 2.7; 280/11.26; 24/68

[56] References Cited

U.S. PATENT DOCUMENTS

| | | | |
|---|---|---|---|
| 3,219,358 | 11/1965 | Hagner | 482/77 |
| 3,963,252 | 6/1976 | Carlson | 280/11.26 |
| 4,893,809 | 1/1990 | Blankenzee | 480/77 |
| 5,301,441 | 4/1994 | Kownacki | 482/77 |
| 5,416,952 | 5/1995 | Dodge | 24/68 |

FOREIGN PATENT DOCUMENTS

| | | | |
|---|---|---|---|
| 0152969 | 8/1985 | European Pat. Off. | 482/77 |
| 0465909 | 9/1928 | Germany | 482/77 |
| 273105 | 4/1951 | Switzerland | 482/77 |
| 0370108 | 4/1931 | United Kingdom | 482/77 |

*Primary Examiner*—Jerome Donnelly
*Attorney, Agent, or Firm*—Flehr Hohbach Test Albritton & Herbert LLP

[57] ABSTRACT

Bouncing boot having a platform, a resilient bouncing element with a hemispheric lower portion mounted in a fixed position on the under side of the platform, heel and toe pieces mounted on the upper side of the platform for receiving the foot of a person, and straps for securing the foot in the heel and toe pieces.

11 Claims, 2 Drawing Sheets

BOUNCING BOOT

This invention pertains generally to recreational toys and the like and, more particularly, to a boot which enables the wearer to bounce up and down.

Pogo sticks have long been used by children and others as a means for bouncing up and down and propelling themselves along the ground. They are, however, somewhat difficult for some people to learn to use since they have a single point of contact with the ground. The user must learn to balance about that point, and even then there is a risk of serious injury if the person should lose his balance. Another problem with pogo sticks is that the spring which propels them may be too stiff or too weak for a given person.

It is in general an object of the invention to provide a new and improved bouncing device for use by children and others.

Another object of the invention is to provide a bouncing device of the above character which overcomes the limitations and disadvantages of pogo sticks and other bouncing devices heretofore provided.

These and other objects are achieved in accordance with the invention by providing a pair of bouncing boots, each of which comprises a platform, a resilient bouncing element having a hemispheric lower portion mounted in a fixed position on the under side of the platform, heel and toe pieces mounted on the upper side of the platform for receiving the foot of a person, and means for securing the foot in the heel and toe pieces.

Figure 1:
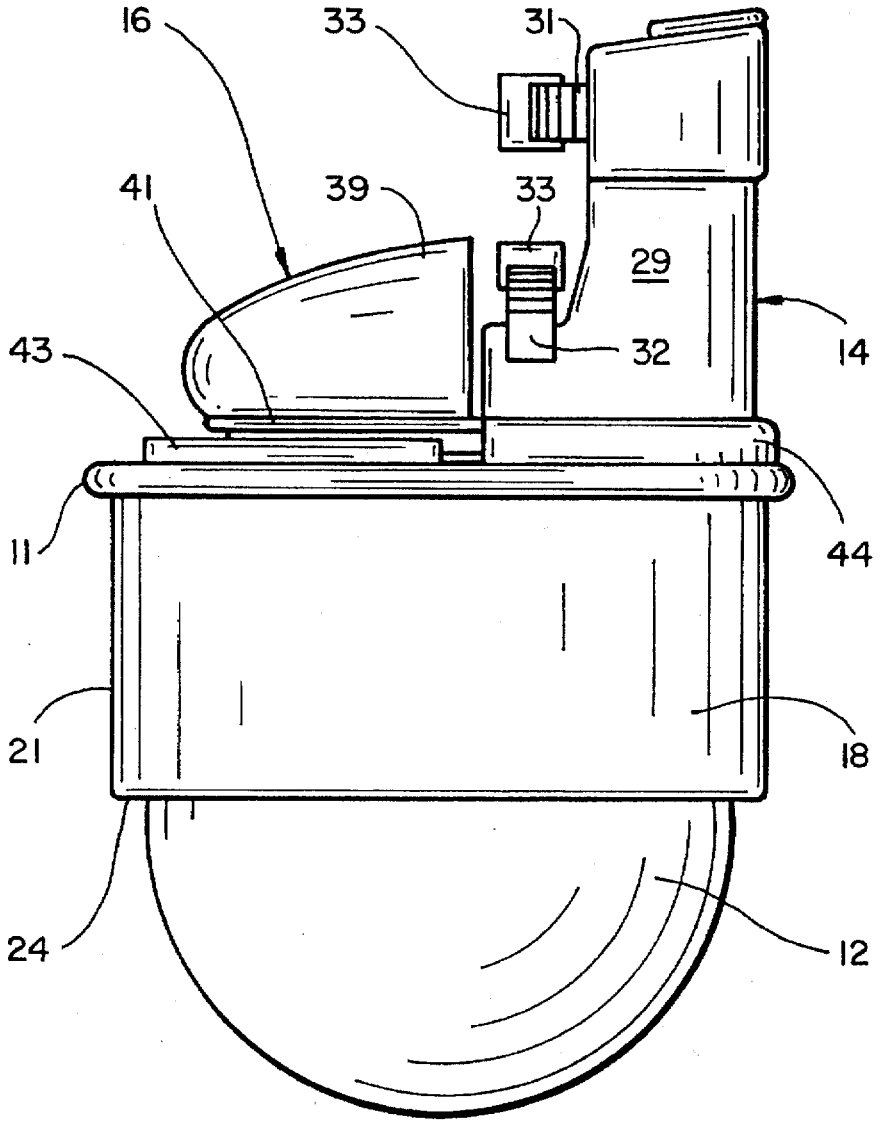
FIG. 1 is side elevational view of one embodiment of a bouncing boot incorporating the invention.
Figure 5:
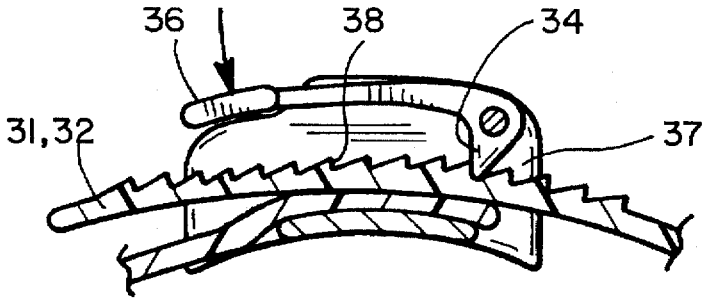
FIG. 5 is a cross-sectional view of one of the quick-release buckles for the ankle and instep straps in the embodiment of FIG. 1.
Figure 2:
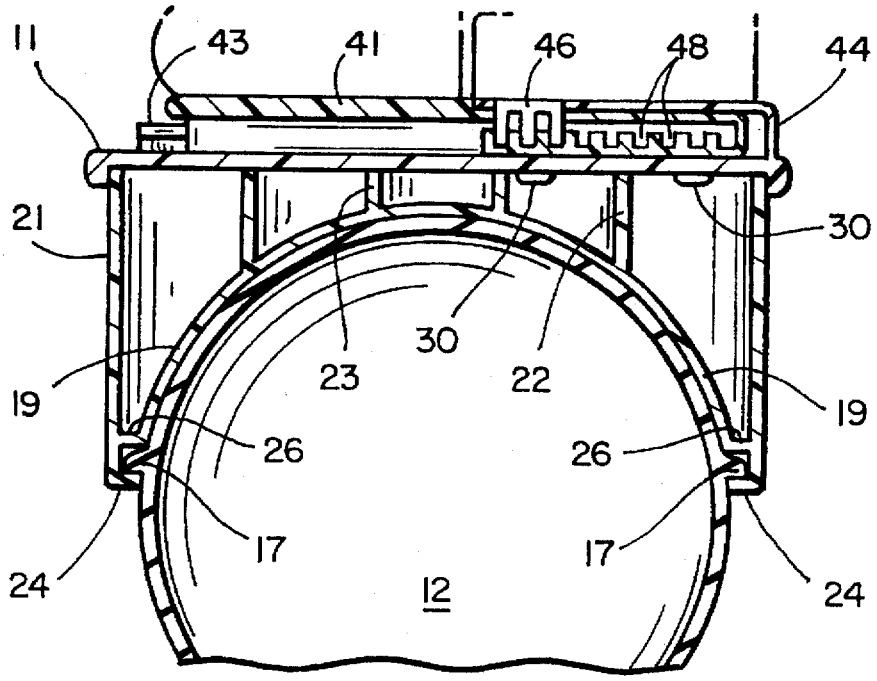
FIG. 2 is a fragmentary vertical sectional view of the embodiment of FIG. 1.
Figure 3:
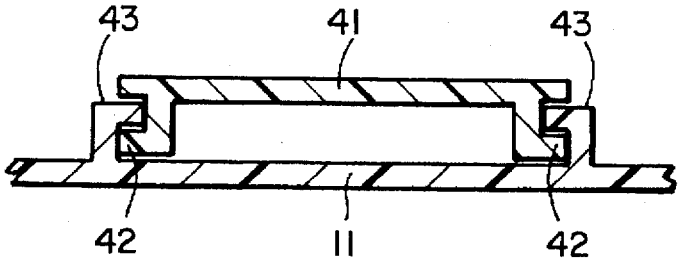
FIG. 3 is a fragmentary vertical sectional view of the guide rails and hold down flanges for the toe piece in the embodiment of FIG. 1.
Figure 4:
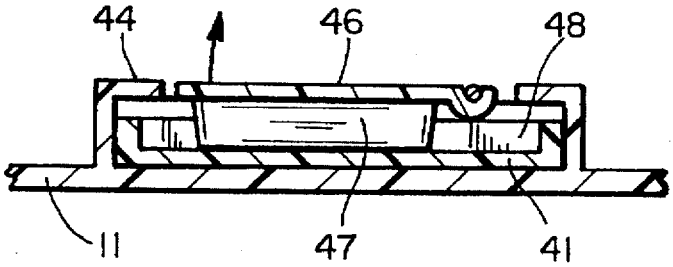
FIG. 4 is a fragmentary sectional view of the lock clip for the toe piece in the embodiment of FIG. 1.

As illustrated in FIG. 1, the boot comprises a generally circular base plate or platform 11, with a resilient spherical ball 12 on the under side of the platform, and heel and toe pieces 14, 16 for receiving the foot of a user on the upper side of the platform. The platform and the ball are approximately equal in diameter, and in a boot intended for use by children, that diameter is typically on the order of 200 mm. The platform is fabricated of a rigid material such as high density polyethylene, and the ball is fabricated of a resilient material such as polyvinyl chloride (PVC). They can be manufactured by a process such as molding.

The ball includes a laterally projecting ring 17 which is formed as an integral part of the ball. The ring extends horizontally and encircles the ball above its centerline. The ball is pneumatically inflated and includes a valve (not shown) through which air can be introduced and removed to control the firmness of the ball.

The ball is mounted to the under side of the platform by a retainer 18 which includes a semispherical bottom wall 19, a cylindrical side wall 21, and a pair of cylindrical inner supports 22, 23 disposed concentrically of the side wall. An annular flange 24 extends in an inward direction from the lower portion of the side wall, and the lower portion of semispherical wall 19 is connected to the side wall by an annular flange 26 which is spaced above flange 24. The upper ends of side wall 21 and inner supports 22, 23 are affixed to the lower side of platform 11 by sonic welding or other suitable means.

The retainer forms a socket for the ball, with the upper portion of the ball engaging the under side of wall 19, and ring 17 positioned between flanges 24, 26. The annular shoulder on the under side of the ring is in facing engagement with the upper surface of flange 24 to retain the ball in the socket.

Heel piece 14 comprises a heel cup 29 which is open at the front and at the top for receiving the heel of the person wearing the boot, with straps 31, 32 for retaining the heel in the cup. The heel cup is fabricated of a rigid material such as high density polyethylene or PVC, and is affixed to the platform by rivets 30 or other suitable means.

Straps 31, 32 are fabricated of a flexible material such as soft PVC, with strap 31 wrapping about the ankle and strap 32 passing over the instep. The straps are received in buckles 33 each of which has a pawl 34 with an operating lever 36 pivotally mounted between a pair of side plates 37 for engaging teeth 38 formed in the straps. This permits the straps to be engaged and disengaged quickly and provides adjustment for feet of different sizes.

Toe piece 16 is slidably mounted on the platform for movement relative to the heel cup to accommodate feet of different lengths. The toe piece consists of a toe holder 39 affixed to a toe plate 41 which extends rearwardly of the holder. The front portion of the toe plate has a pair of laterally extending flanges 42 which engage longitudinally extending rails 43 on the platform to hold the front portion of the toe plate down on the platform while permitting it to move longitudinally. The rear portion or extension of the toe plate is received in a housing 44 on the platform. A lock clip 46 is pivotally mounted on the upper wall of the housing and has depending lugs 47 which fit into transverse slots 48 in the toe plate extension to secure the toe plate in a desired position.

The toe cup and plate are each fabricated of a rigid material such as high density polyethylene or PVC and are affixed together by suitable means such as cementing.

In use, the boots are typically worn in pairs, with one boot on each foot of the user. They are adjusted to the desired length by raising lock clip 46 to disengage lugs 47 from slots 48, sliding the toe piece to the desired position, and depressing the lock clip to reengage the lugs. The user then slides his toe into the toe holder, steps down into the heel cup, and secures straps 31, 32 about the ankle and instep of his foot. The straps are held securely by the locking buckles, yet can be released quickly and easily if desired.

Once a person has put on the boots, he can bounce up and down upon the resilient balls, enjoying somewhat the same springing action as provided by a pogo stick, but with much greater stability and safety. Since the balls do not rotate, they can also be walked upon safely.

It is apparent from the foregoing that a new and improved bouncing device has been provided. While only certain presently preferred embodiments have been described in detail, as will be apparent to those familiar with the art, certain changes and modifications can be made without departing from the scope of the invention as defined by the following claims.

We claim:

1. A bouncing boot, comprising a generally circular platform, means for securing the foot of a person to the upper side of the platform, a downwardly facing hemispherical socket beneath the platform, an annular flange extending inwardly in a fixed position near the lower edge of the socket, and a resilient spherical ball positioned beneath the platform and having an upper hemispherical portion disposed in the socket and a lower hemispherical portion projecting through an opening in the annular flange, the opening being of lesser diameter than the ball whereby the ball is retained in the socket by the flange.

2. The bouncing boot of claim 1 wherein the means for securing the foot further comprises an upper strap which wraps about the ankle and a lower strap which passes over the instep of the foot.

3. The bouncing boot of claim 2 wherein each of the straps is received in a buckle having a pivotally mounted pawl with an operating lever for engaging the pawl with the strap.

4. The bouncing boot of claim 3 wherein each of the straps has a plurality of transversely extending teeth which are selectively engagable with the pawl to adjust the length of the strap for feet of different sizes.

5. The bouncing boot of claim 1 wherein the ball has an annular shoulder in facing engagement with an upper surface of the annular flange between the upper and lower portions of the ball.

6. The bouncing boot of claim 1 wherein the means for securing the foot of a person comprises heel and toe pieces mounted on the upper side of the platform.

7. The bouncing boot of claim 6 wherein one of the heel and toe pieces is adjustably mounted on the platform to accommodate feet of different sizes.

8. The bouncing boot of claim 1 wherein the ball has a diameter on the order of 200 mm.

9. A bouncing boot, comprising a platform, a resilient bouncing element having a lower portion in the shape of a complete hemisphere mounted in a fixed position on the under side of the platform, a heel piece mounted in a fixed position on the upper wall of a housing toward the rear of the platform, an adjustable toe piece having a toe holder for receiving the front portion of the foot of a person and a plate which extends rearwardly of the toe holder and is slidably mounted on the upper side of the platform end extends into the housing beneath the heel piece for movement relative to the heel piece, and means for securing the foot to the heel piece.

10. The bouncing boot of claim 9 wherein the means for securing the foot to the heel piece comprises an upper strap which wraps about the ankle and a lower strap which passes over the instep of the foot.

11. The bouncing boot of claim 9 further including a lock clip pivotally mounted to the housing and having a depending lug which is selectively engagable with one of a plurality of transversely extending slots in the toe piece plate for holding the toe piece in different positions relative to the heel piece.

* * * * *